US012650019B2

(12) United States Patent
Letham

(10) Patent No.: US 12,650,019 B2
(45) Date of Patent: Jun. 9, 2026

(54) REINFORCED SLATWALL ASSEMBLY

(71) Applicant: Solutions Murales Proslat, Inc., Salaberry-de-Valleyfield (CA)

(72) Inventor: Eric Letham, Chateauguay (CA)

(73) Assignee: Solutions Murales Proslat, Inc., Salaberry-de-Valleyfield (CA)

( * ) Notice: Subject to any disclaimer, the term of this patent is extended or adjusted under 35 U.S.C. 154(b) by 50 days.

(21) Appl. No.: 18/583,512

(22) Filed: Feb. 21, 2024

(65) Prior Publication Data

US 2024/0247493 A1 Jul. 25, 2024

Related U.S. Application Data

(63) Continuation of application No. 17/498,991, filed on Oct. 12, 2021, now Pat. No. 11,939,776.

(60) Provisional application No. 63/091,995, filed on Oct. 15, 2020.

(51) Int. Cl.
*E04F 13/08* (2006.01)
*A47F 5/08* (2006.01)

(52) U.S. Cl.
CPC ..... *E04F 13/0803* (2013.01); *A47F 5/0846* (2013.01)

(58) Field of Classification Search
CPC . E04F 13/089; E04F 13/0894; E04F 13/0803; E04F 13/12; A47F 5/0846; A47B 96/067; A47B 83/001
USPC ..... 52/36.4–36.6
See application file for complete search history.

(56) References Cited

U.S. PATENT DOCUMENTS 4,531,331 A * 7/1985 Itagaki ..... A47F 5/0846 52/630
4,674,240 A * 6/1987 Strausheim ..... A47F 5/0846 52/542
5,412,912 A 5/1995 Alves
5,819,490 A * 10/1998 Current ..... A47F 5/0846 52/630
D403,085 S * 12/1998 Current ..... D25/123
(Continued)

FOREIGN PATENT DOCUMENTS

CA 2685707 A1 5/2010
CA 2671182 C 2/2015
(Continued)

*Primary Examiner* — Brian E Glessner
*Assistant Examiner* — Adam G Barlow
(74) *Attorney, Agent, or Firm* — Flaster Greenberg P.C.

(57) ABSTRACT

A slatwall assembly and related slatwall for covering an existing wall. The slatwall assembly includes a surface profile and a reinforcing profile, at least one of the two being attachable to the existing wall. The surface profile includes a front vertical panel that is positionable with respect to the existing wall to define a gap therebetween and provide coverage thereto. The reinforcing profile is operatively coupled to the surface profile. The material of the reinforcing profile can be stronger than the material of the surface profile for reinforcement thereof when coupled together. The reinforcing profile can be operatively coupled to the surface profile so as to be held together for attachment onto the existing wall. The surface profile can be configured to cover at least a portion of the reinforcing profile, so as not to expose the reinforcing profile when an entire slatwall is assembled from the plurality of slatwall assemblies.

20 Claims, 7 Drawing Sheets

(56) References Cited

U.S. PATENT DOCUMENTS 5,899,344 A * 5/1999 Current ..... A47F 5/0846 264/45.9
D414,567 S * 9/1999 Burt ..... D25/123
6,134,846 A * 10/2000 Lamb ..... A47F 5/0846 52/36.5
6,325,223 B1 * 12/2001 Hannen ..... A47F 5/0846 211/87.01
6,811,043 B2 * 11/2004 Perkins ..... A47F 5/0018 211/94.01
7,228,977 B2 * 6/2007 Perkins ..... A47B 95/008 211/94.01
7,296,695 B2 * 11/2007 Perkins ..... A47F 5/0846 312/249.8
D613,520 S * 4/2010 Goodman ..... D25/138
8,205,395 B2 * 6/2012 Jakiel ..... A47F 5/0846 52/36.5
8,746,472 B2 * 6/2014 Thrush ..... A47B 96/067 211/94.01
8,763,312 B2 * 7/2014 Carter ..... E04F 13/0894 52/36.5
10,492,631 B2 * 12/2019 Velderman ..... A47F 5/0853
2004/0251227 A1 * 12/2004 Perkins ..... A47B 21/06 248/220.21
2006/0091094 A1 * 5/2006 Schuberth ..... A47F 5/0846 211/94.01
2007/0221594 A1 * 9/2007 Pierro ..... A47F 5/0846 211/94.01
2008/0105637 A1 * 5/2008 Lawson ..... A47F 5/0853 211/94.01
2009/0293391 A1 * 12/2009 DeVore ..... A47B 83/001 52/745.1
2010/0122505 A1 * 5/2010 Jakiel ..... E04F 13/18 52/762
2011/0185667 A1 * 8/2011 Carter ..... E04B 2/46 52/582.1
2015/0108307 A1 * 4/2015 Simon ..... F16M 11/2014 248/231.91
2016/0018054 A1 * 1/2016 Simon ..... F16M 11/2014 248/222.14
2016/0060876 A1 3/2016 Bordener
2020/0060439 A1 * 2/2020 Velderman ..... A47F 5/0853
2020/0141125 A1 * 5/2020 O'Neal ..... E04F 13/0803
2020/0187677 A1 * 6/2020 Thrush ..... F16B 45/00

FOREIGN PATENT DOCUMENTS

CA 3010903 A1 7/2017
DE 10150889 A1 4/2003

* cited by examiner

REINFORCED SLATWALL ASSEMBLY

CROSS-REFERENCE TO RELATED APPLICATION

This application is a continuation of U.S. Non-Provisional application Ser. No. 17/498,991, filed Oct. 12, 2021, which claims the benefit of U.S. Provisional Patent Application No. 63/091,995, filed Oct. 15, 2020, the entire contents of which are hereby incorporated herein by reference.

TECHNICAL FIELD

The technical field generally relates to slatwall elements that are assembled to form a slatwall, and more particularly to a reinforced slatwall assembly including a reinforcing profile and a surface profile

BACKGROUND

Slatwalls are used to organize and display items over the surface of an existing wall. A slatwall includes a plurality of elongated panels or profiles that can be made of various materials and levels of thickness, and that are configured to cover at least a portion of the surface of the wall. The profiles generally include grooves for insertion of hooks, shelf brackets and other mounting backets, so as to suspend items to be organized and displayed onto the slatwall. The profiles are directly secured to the wall via standard fastening mechanisms including screws and nails.

Depending on the weight of the items to be suspended onto the slatwall, the fastening mechanism can be insufficient to effectively hold the profiles onto the wall and the grooves can be damaged by the brackets or hooks.

There is thus a need for a slatwall that overcomes at least some of the drawbacks of what is known in the field.

SUMMARY

The presently described slatwall assembly includes a surface profile and a reinforcing profile. The surface profile is reinforced by being operatively coupled to the reinforcing profile. The reinforcing profile can be configured to be held together with the surface profile via at least one fastener when the slatwall assembly is mounted onto an existing wall. The surface profile can also be advantageously designed to hide at least a portion of the reinforcing profile when coupled therewith, such that the reinforcing profiles are not exposed when an entire slatwall is assembled via juxtaposition of a plurality of slatwall assemblies described herein.

In one aspect, there is provided a slatwall assembly for covering an existing wall, the slatwall assembly comprising:

- a surface profile defining a groove and comprising a front vertical panel that is positionable with respect to the existing wall to define a gap therebetween and provide coverage thereto; and
- a reinforcing profile being operatively coupled to the surface profile via insertion of the reinforcing profile into the groove of the surface profile, so as to be held together for attachment onto the existing wall.

In another aspect, there is provided a slatwall assembly for covering an existing wall, the slatwall assembly comprising:

- a surface profile comprising a front vertical panel that is positionable with respect to the existing wall to define a gap therebetween and provide coverage thereto; and

- a reinforcing profile being operatively coupled to the surface profile so as to be held together for further securing onto the existing wall;

wherein the reinforcing profile is made of a material that is stronger than the material of the surface profile for reinforcement thereof when coupled together.

Optionally, the reinforcing profile can be operatively coupled to the surface profile so as to be held together via insertion of the reinforcing profile into a groove of the surface profile. Further optionally, the slatwall assembly can be secured to the wall via at least one fastener that cooperates with at least one of the surface profile and the reinforcing profile. Further optionally, the surface profile can be configured to cover at least a portion of the reinforcing profile.

In another aspect, there is provided a slatwall assembly for mounting to an existing wall, the slatwall assembly comprising:

- a surface profile comprising:
  - a base wall that is horizontally extending,
  - a rear lip extending upwardly from the base wall, the rear lip having a rear surface being positionable directly onto the existing wall,
  - a front lip extending upwardly from the base wall and being spaced apart from the rear lip to define a groove therebetween, and
  - a front vertical panel extending downwardly from the base wall so as to be spaced apart from the existing wall and to define a gap therebetween; and
- a reinforcing profile, the reinforcing profile comprising:
  - a reinforcing base wall that is horizontally extending, and
  - a rear vertical wall extending laterally from each side of a rear edge of the reinforcing base wall, thereby defining an upward tab and a downward tab;

wherein the reinforcing profile is operatively coupled to the surface profile via insertion of the downward tab of the reinforcing profile into the groove of the surface profile, so as to form a sandwich-like structure with the front and rear lips.

In some implementations of the slatwall assembly, a rear surface of the rear vertical wall of the reinforcing profile can abut a front surface of the rear lip of the surface profile. For example, the rear vertical wall can be nested in the rear lip. Optionally, the rear lip can include a top overhang extending from a top edge of the rear lip, and the top overhang abuts a top edge of the rear vertical wall.

In some implementations of the slatwall assembly, the groove of the surface profile can be shaped to include a recess, and the downward tab of the rear vertical wall comprises an overhang that is nested in the recess of the groove. For example, the recess can be located in a bottom portion of the groove and the overhang of the downward tab extends from a bottom edge of the rear vertical wall.

In some implementations of the slatwall assembly, the front lip can be sized differently from the rear lip of the surface profile. For example, the front lip can be sized to cover at least a portion of the reinforcing profile. For example, the front lip can be sized to cover a substantially entire front surface of the downward tab and extends upwardly to a bottom surface of the reinforcing base wall of the reinforcing profile.

In some implementations of the slatwall assembly, at least one of the reinforcing profile and the surface profile can be securable onto the existing wall via at least one fastener. For example, both the reinforcing profile and the surface profile are securable onto the existing wall by being held together via the at least one fastener. Optionally, the upward tab of the rear vertical wall of the reinforcing profile can be adapted to cooperate with the fastener to hold the reinforcing profile and the surface profile together onto the existing wall via the fastener.

Further optionally, the reinforcing profile further can include an upper lip and a lower lip extending horizontally from a front surface of the upward tab, the upper lip being spaced apart from the lower lip to define a channel therebetween, and the at least one fastener being insertable within the channel and abutting a front edge of the upper and lower lips when the slatwall assembly is secured to the existing wall. For example, the upward tab of the reinforcing profile can have a secondary groove that is further recessed with respect to the channel to facilitate positioning of the fastener.

In some implementations of the slatwall assembly, both rear and front lips extend upwardly from a rear end portion of the base wall of the surface profile.

In some implementations of the slatwall assembly, the front vertical panel of the surface profile can extend downwardly from a front edge of the base wall of the surface profile.

In some implementations of the slatwall assembly, the slatwall assembly can be a first slatwall assembly and the front vertical panel of the surface profile of the first slatwall assembly can be adapted to lodge at least a portion of the reinforcing profile of a second slatwall assembly that is positionable below the first slatwall assembly. Optionally, the front vertical panel of the surface profile can be sized to hide both reinforcing base wall and upward tab of the reinforcing profile of the second slatwall assembly behind the front vertical panel of the first slatwall assembly. Further optionally, the front vertical panel of the surface profile can include an inward lip extending from a rear surface of the front vertical panel to abut the reinforcing base wall of the reinforcing profile of the second slatwall assembly when the first slatwall assembly overlaps the second slatwall assembly. For example, the reinforcing profile further can include an upward locking tab extending upwardly from a top surface of the reinforcing base wall, the upward locking tab being adapted to abut the inward lip of the front vertical panel of a third and upper slatwall assembly positionable above the first slatwall assembly.

In some implementations of the slatwall assembly, the reinforcing profile can be shaped to form a cavity that is recessed with respect to the front vertical panel of the surface profile and having a front opening to allow insertion and locking of mounting brackets for hanging items onto the existing wall. Optionally, the reinforcing profile can further include a downward locking tab extending downwardly from a bottom surface of the reinforcing base wall, with the downward locking tab, the reinforcing base wall, the front lip of the surface profile and the base wall of the surface profile forming the cavity.

In some implementations of the slatwall assembly, the surface profile can be made of plastic, polymer composite material, wood, wood composite material, or cardboard.

In some implementations of the slatwall assembly, the reinforcing profile can be made of metal, carbon fibers or fiberglass.

In some implementations of the slatwall assembly, the slatwall assembly can include a top layer that is laminated on a front surface of the front vertical panel to provide a given color, pattern and/or texture thereto.

It should be noted that each and everyone of the above-mentioned aspects or implementations of the slatwall assembly can be further combined with at least one additional feature of the slatwall assembly further described herein. Advantages and other features of the present slatwall assembly and related techniques will become more apparent and be better understood upon reading of the following non-restrictive description, given with reference to the accompanying drawings.

While present techniques will be described in conjunction with example embodiments, features and implementations. It will be understood that it is not intended to limit the scope of the techniques to such embodiments or implementations. On the contrary, it is intended to cover all alternatives, modifications and equivalents as can be included as defined by the present description.

DETAILED DESCRIPTION

There is provided a slatwall assembly that can be mounted onto an existing wall in a repetitive pattern to cover at least a portion of a surface of the wall. The slatwall assembly can offer anchoring regions to facilitate organization and display of items onto the existing wall. The slatwall assembly can be described as "hybrid" since the assembly includes two profiles, each profile having a specific function to serve within the assembly.

Figure 1:
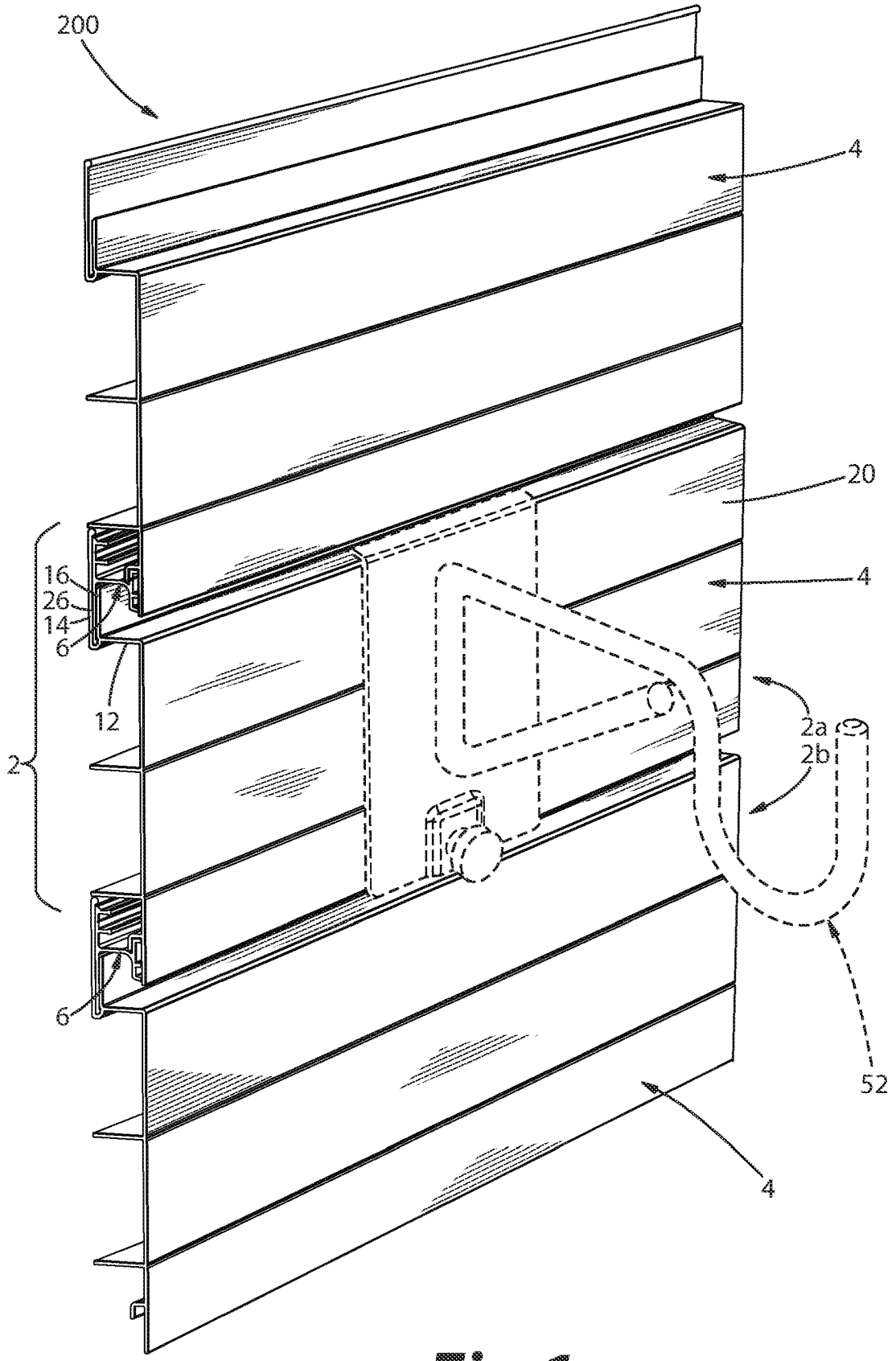
FIG. 1 is a top perspective view of a slatwall including two slatwall assemblies and an additional surface profile.
Figure 7:
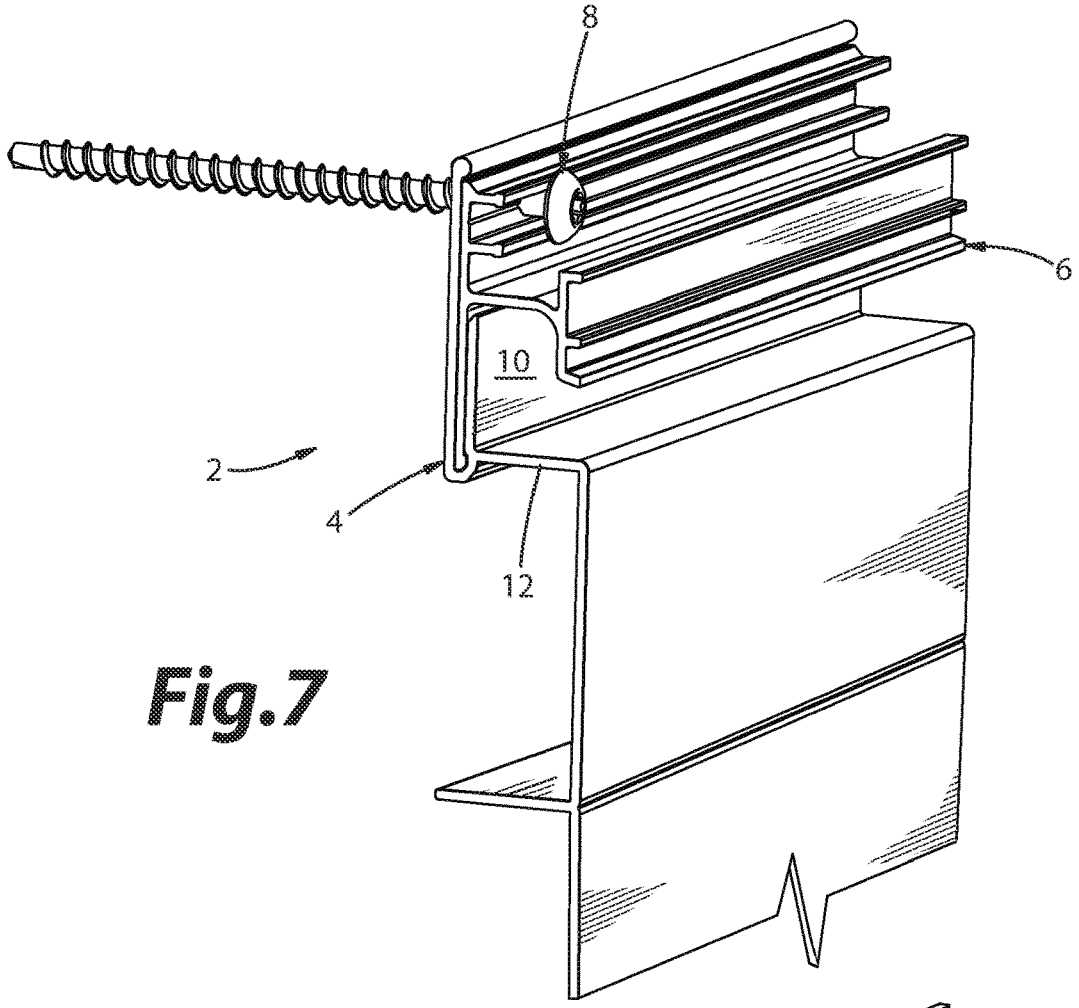
FIG. 7 is a top perspective view of a portion of a first slatwall assembly being coupled to a fastener.
Figure 8:
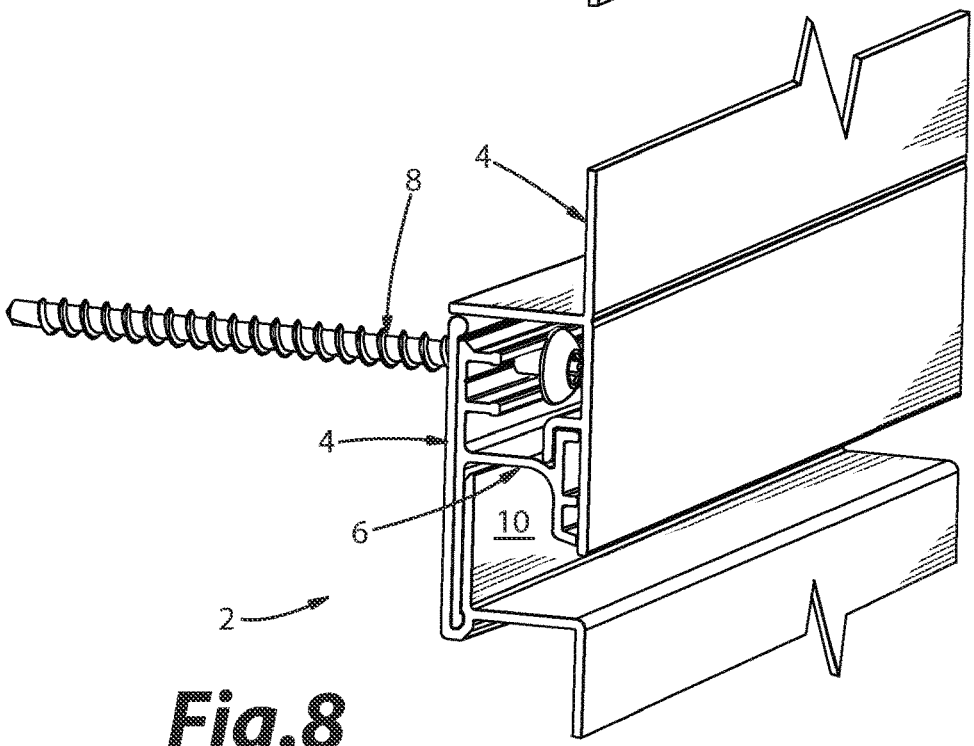
FIG. 8 is a top perspective view of another portion of the first slatwall assembly of FIG. 7 being seen adjoined to a portion of a second and identical slatwall assembly.

Referring to FIG. 1, the slatwall assembly (2) as defined herein comprises a surface profile (4) and a reinforcing profile (6), that are connected to one another in a secured fashion. A slatwall (200) can be formed by assembling adjacent slatwall assemblies (2) via each reinforcing profile (6) from a plurality of slatwall assemblies (2). FIGS. 7 and 8, when combined, show two adjacent and overlapping slatwall assemblies (2), each slatwall assembly (2) being for example secured onto the existing wall with fasteners (8). FIG. 6 illustrates a single slatwall assembly mounted onto the existing wall (1) via the fastener (8). Referring to FIGS. 2 to 5, the slatwall assembly can be assembled from a slatwall kit (20) including the two profiles (4, 6) being provided in a disconnected fashion.

Each one of the reinforcing profile and the surface profile of the slatwall assembly is a one-piece structure that can be molded or extruded. More specifically, referring to FIG. 6, the surface profile (4) that is used to cover at least a portion of the existing wall (1) can be made of a lightweight yet durable material. It should be further noted that the surface profile can be made of a material having a certain degree of flexibility and resilience to allow a functional engagement between specific parts of the assembly in general. Many materials could be used to produce the surface profile, and can include, but are not limited to, plastic, polymer composite material, wood, wood composite material, and cardboard. For example, the plastic can be PVC.

Still referring to FIG. 6, the slatwall assembly (2) further includes the reinforcing profile (6) that is operatively coupled to the surface profile (4) so as to strengthen at least a portion of the surface profile (4). For example, the reinforcing profile (6) is provided to strengthen at least the portion (e.g., rear lip 14) of the surface profile (4) that is to be secured onto the wall. The design and material of the reinforcing profile (6) are chosen to enhance a strength of the connection of the surface profile (4) with the existing wall (1) and a resistance to deformation of the surface profile (4) upon holding items onto the slatwall assembly. More specifically, the surface profile (4) and the reinforcing profile (6) are connected to one another via operative coupling of specific parts of the profiles which are described further below, and at least one of the surface profile (4) and the reinforcing profile (6) is further held onto the existing wall (1), e.g., via the fastener (8).

In some implementations, the surface profile (4) and the reinforcing profile (6) can be made of a different material. The reinforcing profile (6) can be made of a stronger material than the surface profile (4) so as to provide enhanced rigidity and further distribute the mechanical constraints that are imposed to the surface profile (4). The reinforcing profile can be made of metal, carbon fibers, fiberglass or a combination thereof. Optionally, the metal can be aluminum or steel. The term "strong" is used herein to refer to the strength of a material. The reinforcing profile can be made of a material that is considered stronger than the material of the surface profile, i.e. that the reinforcing profile can be made to have an enhanced ability to withstand an applied load without plastic deformation or failure, in comparison to the surface profile alone.

It should be noted that the various positions, directions and orientations as used herein, such as "front", "rear", "top", "bottom", "upper", "lower", "horizontal" and "vertical" are to be interpreted in the context of the Figures showing the slatwall assembly and parts thereof being oriented with respect to a vertically extending wall.

More particularly, the surface profile is configured to define a groove that is sized to engage a tab of the reinforcing profile such that the surface profile and the reinforcing profile are held together in a "sandwich-like" configuration. Details regarding example implementations of the surface and reinforcing profiles are provided further below.

Figure 2:
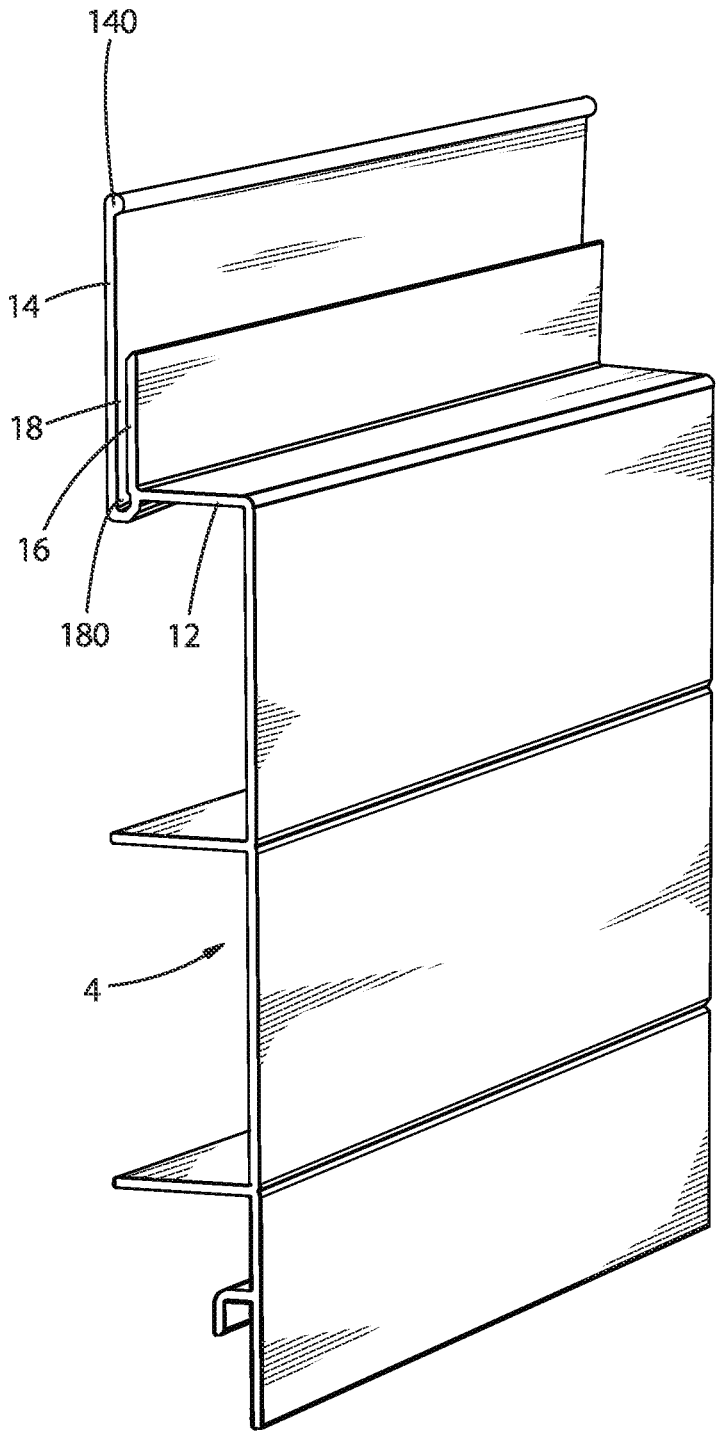
FIG. 2 is a top perspective view of a surface profile of a slatwall assembly.
Figure 9:
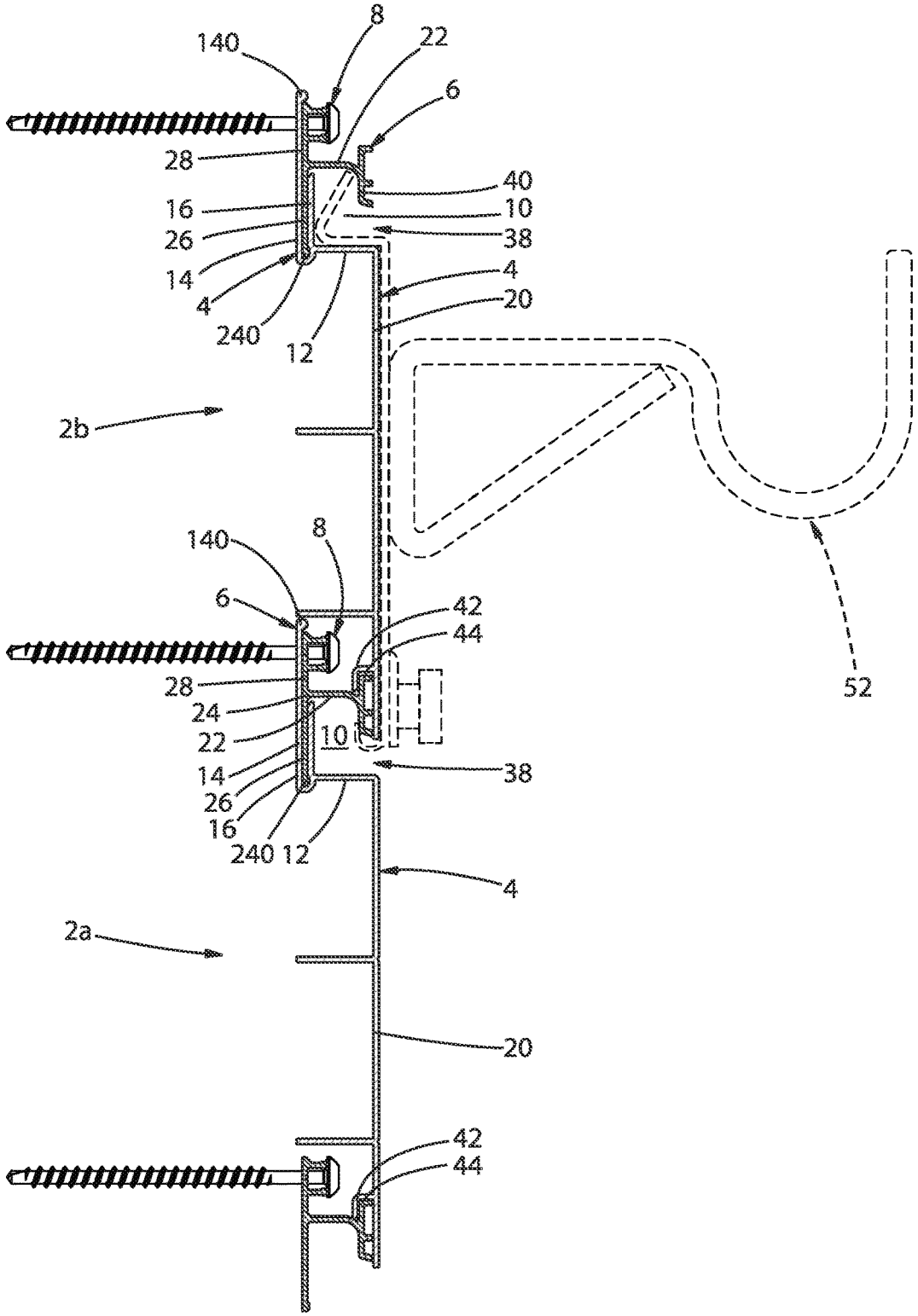
FIG. 9 is a cross-sectional view of a first slatwall assembly and a second slatwall assembly, each slatwall assembly being adjoined to the reinforcing profile of the adjacent slatwall assembly.

In the implementation shown in FIG. 9, the surface profile (4) includes a base wall (12) that is generally horizontally extending. A top surface of the base wall (12) can serve as an abutment surface for any mounting brackets (52) to be coupled to the slatwall assembly. The surface profile (4) further includes a pair of front and rear lips (14, 16) which extend generally upwardly from an edge portion of the base wall (12). Referring to FIG. 6, the rear lip (14) has a rear surface that can be positioned directly onto the existing wall (1). Referring to FIG. 2, the front lip (16) is spaced apart from the rear lip (14) so as to define a groove (18) therebetween. Referring to FIG. 6, the surface profile (4) further includes a front vertical panel (20) extending downwardly from the base wall (12) so as to be spaced apart from the existing wall (1) and to define a gap therebetween.

Figure 3:
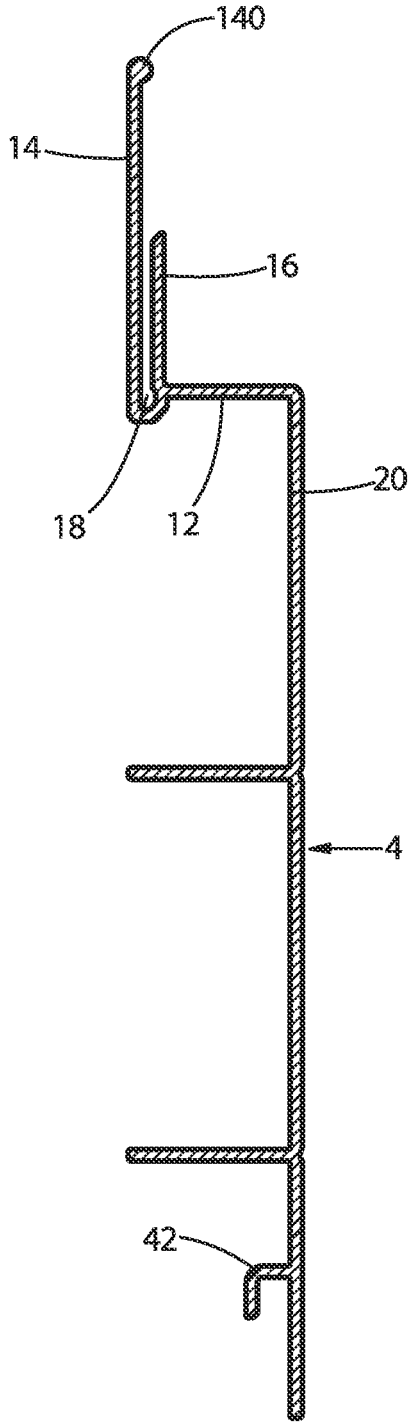
FIG. 3 is a cross-sectional view of the surface profile of FIG. 2 along a vertical axis.

FIGS. 2, 3 and 6 show an implementation where the front and rear lips (14, 16) extend from a rear edge portion of the base wall (12) and the front vertical panel (20) extends downwardly from a front edge portion of the base wall (12). However, implementations of the reinforced slatwall assembly are not limited to those illustrated as examples, and the design of the surface profile could vary to accommodate different designs of the reinforcing profile, differing or not from the one illustrated in FIGS. 4 and 5.

For each slatwall assembly composing the slatwall, the surface profile is generally configured to cooperate with a corresponding reinforcing profile without exposing such reinforcing profile from a front of the assembled slatwall. Thus, the reinforcing profile ensures to improve the weight-bearing capacity of the slatwall (in comparison to a slatwall resulting from the assembly of PVC surface profiles only for example) without compromising the overall aesthetic of the slatwall.

Figure 4:
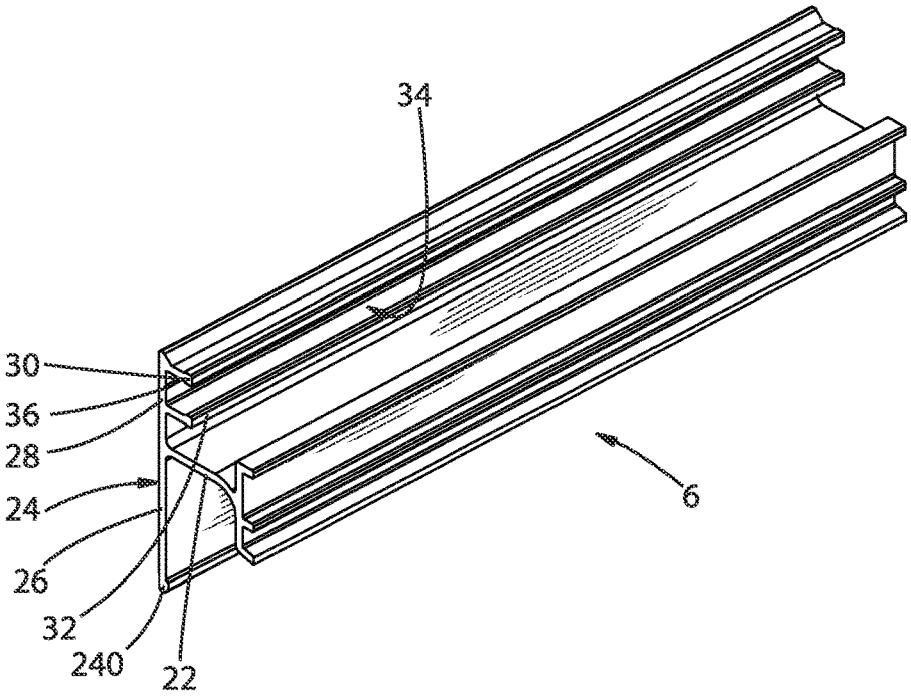
FIG. 4 is a top perspective view of a reinforcing profile of a slatwall assembly.
Figure 5:
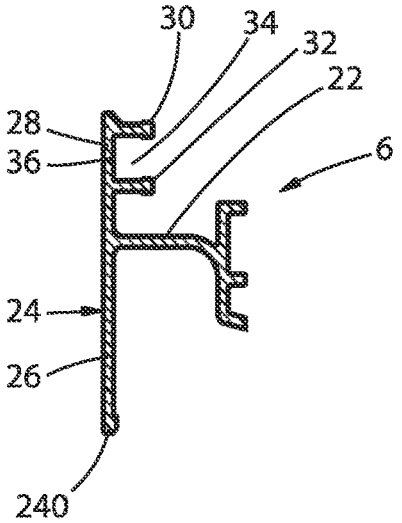
FIG. 5 is a cross-sectional view of the reinforcing profile of FIG. 4 along a vertical axis.
Figure 6:
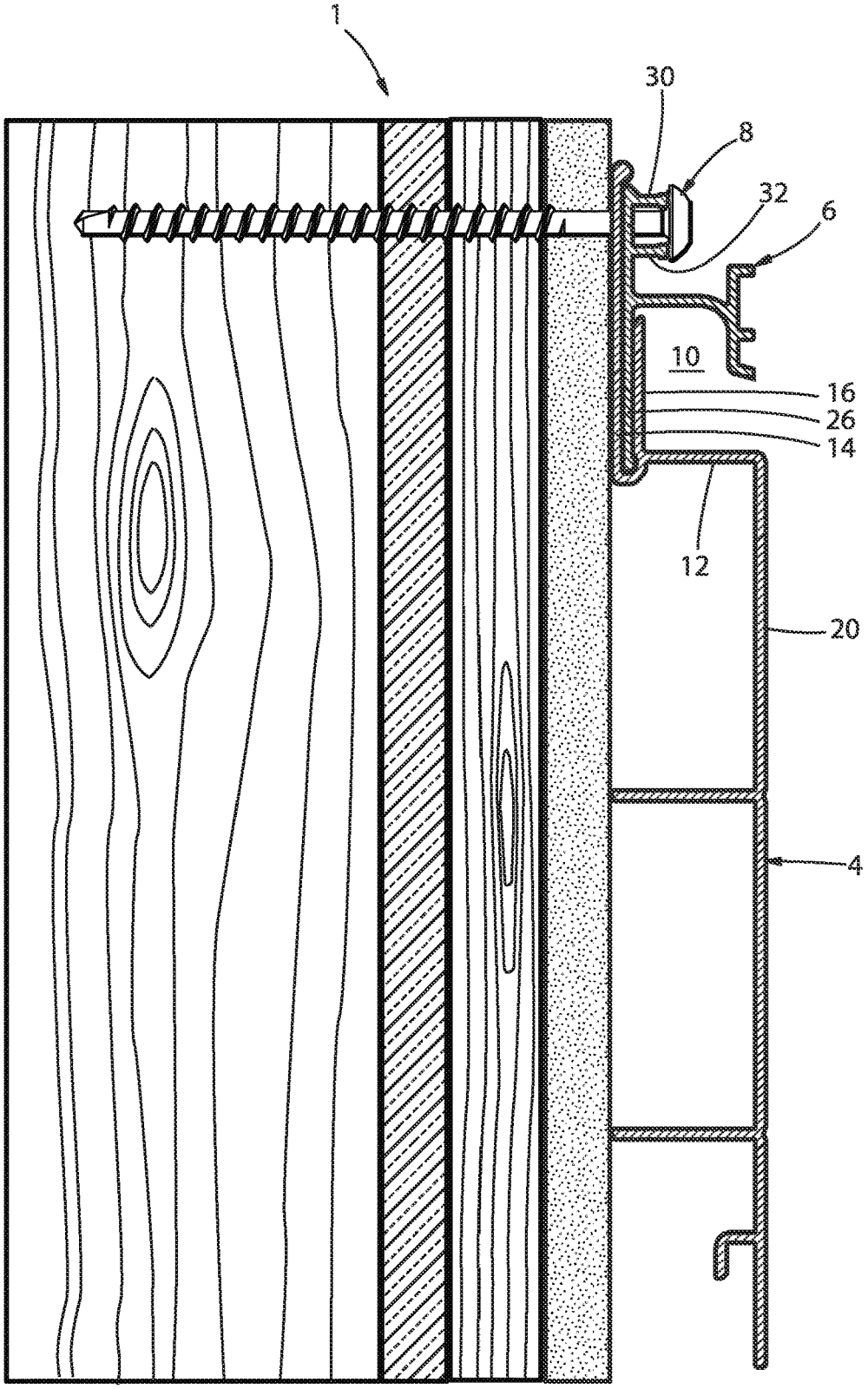
FIG. 6 is a cross sectional view of a slatwall assembly along a vertical axis when secured to an existing wall with a fastener.

FIGS. 4 and 5 show two different views of the same reinforcing profile (6) and FIG. 6 illustrates the reinforcing profile (6) when engaged within the surface profile (4) to form the slatwall assembly (2). Referring to FIGS. 4 and 5, the reinforcing profile (6) has a generally T-shaped cross-section. The reinforcing profile (6) includes a reinforcing base wall (22) that is extending horizontally and a vertical rear wall (24) extending outwardly from each side of the reinforcing base wall (22) so as to define a downward tab (26) and an upward tab (28). The rear vertical wall (24) is sized to cooperate with the groove of the surface profile of the slatwall assembly (not shown in FIGS. 4 and 5).

Referring to the implementation shown in FIG. 6, the downward tab (26) of the reinforcing profile (6) is sized and shaped to be inserted into the groove between the front and rear lips (14, 16) of the surface profile (4). Once inserted between the front and rear lips (14, 16), the downward tab (26) is snugly fitted within the groove in a sandwich-like configuration that contributes to reinforce the surface profile, and particularly the rear lip (14) that is abutted against the wall (1).

Referring to FIG. 2, the groove (18) of the surface profile (4) can have open ends such that the reinforcing profile can be inserted via one open end of the groove and further sliding along the groove (18). Other ways to couple the reinforcing profile with the surface profile (4) can be used and include insertion of the reinforcing profile (6) via a top of the groove, with the surface profile (4) being made of a sufficiently flexible and resilient material to allow a reversible deformation of the front and rear lips (14, 16) for insertion of the downward tab (26) and snug fitting thereof once inserted. Referring to FIG. 6, the rear lip (14) assists in keeping both surface profile (4) and reinforcing profile (6) held together until the adjoined profiles are actually mounted onto the existing wall with the rear surface of the rear lip (14) being in contact with the wall.

As seen in FIG. 9, the rear lip (14) of the surface profile (4) can be designed differently from the front lip (16). For example, the front lip (16) can be made shorter than the rear lip (14) to accommodate the T-shaped cross-section of the reinforcing profile (6). The size of the front lip (16) can be further chosen to cover a substantially entire front surface of the downward tab (26) and extends upwardly to a bottom surface of the reinforcing base wall (22) of the reinforcing profile (6).

In some implementations, the slatwall assembly is designed to be secured to the wall via the rear lip of the surface profile and the rear wall of the reinforcing profile being held together against the wall with at least one fastener. Referring to FIG. 9, the rear lip (14) can be sized such that an entire rear surface of the rear vertical wall (24) of the reinforcing profile (6) abuts against a front surface of the rear lip (14), when the reinforcing profile (6) is nested into the groove of the surface profile (4). The fastener (8) can thereby secure the combined profiles (4, 6) onto the wall with the fastener going through both the rear lip (14) and the rear vertical wall (24) of each assembly (2*a* and 2*b*). This example configuration allows for securing both reinforcing profile (6) and surface profile (4) onto the wall with the rear lip (14) of the surface profile (4) being held together with the rear vertical wall (24) of the reinforcing profile (6). The reinforcing profile (6) can thereby absorb at least a portion of the mechanical constraints imposed to the surface profile (4) and redistribute them along the reinforcing profile (6). In addition, by being inserted into the surface profile (6), the reinforcing profile (4) contributes to preventing the surface profile (6) from moving as well as permitting holding brackets to hook into the reinforcing profile (6) and rest against the surface profile (4). A large portion of the imposed weight is thereby supported by the holding brackets and further transmitted through the reinforcing base wall (22), the rear vertical wall (24) and a downward locking tab (40) (see FIG. 9). By reinforcing these specific areas, the presently described slatwall assembly is more rigid than a typical slatwall assembly made exclusively of a softer material (e.g. PVC).

Figure 11:
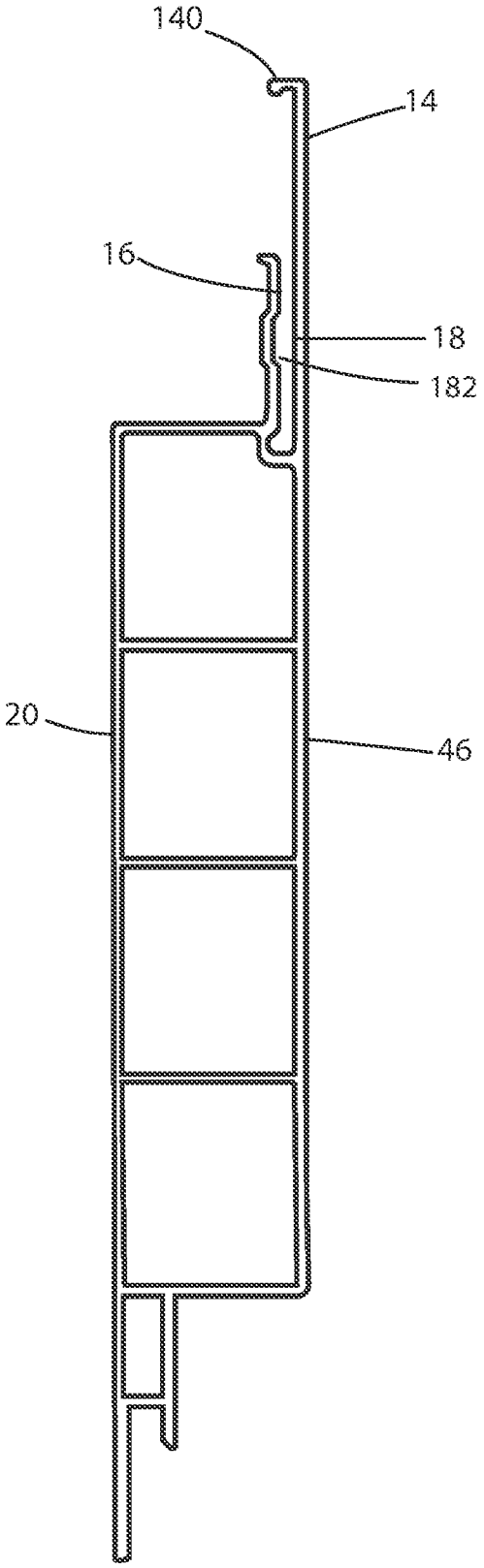
FIG. 11 is a cross-sectional view of yet another implementation of a surface profile of the slatwall assembly.

Still referring to FIG. 9, optionally, the rear vertical wall (24) can be nested in the rear lip (14). For example, the rear lip (14) can include a top overhang (140) extending from a top edge of the rear lip (14), and the top overhang (140) is sized to abut a top edge of the rear vertical wall (24) of the reinforcing profile (6), and thus the upward tab (28). Further optionally, referring to FIG. 2, the groove (18) of the surface profile (4) can be shaped to include a recess (180) that can be, for example, located in a bottom portion of the groove (18). The recess (180) can further contribute to securing the downward tab of the reinforcing profile into the groove (18). Referring to FIG. 9, the downward tab (26) of the rear vertical wall (24) of the reinforcing profile (6) can include an overhang (240) having a shape that is complementary to the recess of the groove. The overhang (240) can thus extend from a bottom edge of the rear vertical wall to match the groove. Referring to FIG. 11, the front lip (16) can be shaped to further include one or more recess(es) (182) to provide locking spaces to the complementary downward tab (26) of the reinforcing profile (6).

It should be noted that, although the slatwall assembly is illustrated in the Figures with both the rear lip of the surface profile and the rear wall of the reinforcing profile being held together against the wall with at least one fastener, other designs the rear lip and/or rear wall are encompassed herein. For example, the rear lip of the surface profile could be made shorter than the rear wall of the reinforcing profile, such that the fastener only goes through the rear wall of the reinforcing profile (and not the rear lip of the surface profile) when the slatwall assembly is secured onto the wall via the fastener.

In some implementations, the upward tab of the rear wall of the reinforcing profile can be adapted to cooperate with at least one fastener so as to hold the slatwall assembly onto the existing wall via at least the reinforcing profile.

For example, referring to FIGS. 4 and 5, the reinforcing profile (6) can include an upper lip (30) and a lower lip (32) extending horizontally from a front surface of the upward tab (28). The upper lip (30) is spaced apart from the lower lip (32) so as to define a channel (34) therebetween. The channel (34) can be used to facilitate positioning of the fastener. As better seen in FIG. 6, the fastener (8) is insertable within the channel and can abut a front edge of the upper and lower lips (30, 32) once the slatwall assembly (2) is secured to the existing wall (1). Optionally, the upward tab of the reinforcing profile can include holes that are distributed along the channel to facilitate insertion of the fastener. In another example, referring to FIGS. 4 and 5, the upward tab (28) of the reinforcing profile (6) can include a secondary groove (36) that is further recessed with respect to the channel (34) to facilitate positioning of the fastener.

It should be noted that the fastener as encompassed herein is at least one fastener, and the slatwall assembly can require several fasteners to be securely held onto the existing wall. The fastener can be any adequate fastener available in the art and includes a screw, a bolt, a nail, and a rivet, which is adapted to secure the slatwall assembly onto the wall.

The slatwall assemblies forming the slatwall are positioned in abutment with respect to one another to define a gap between each surface profile of the slatwall assemblies. Such gap can be further functionalized via insertion of mounting brackets between two surface profiles from two adjacent slatwall assemblies.

In some implementations, as seen in FIG. 9, the slatwall assembly (2) can be further adapted to define a cavity (10) that is inwardly recessed with respect to the front vertical panel (20) of the surface profile (4). For example, the reinforcing profile (6) can be designed to form the cavity (10), once the reinforcing profile (6) is engaged within the surface profile (4). The cavity (10) has an opening to allow insertion and locking of mounting brackets (52) within the cavity (10) for hanging items onto the existing wall (1). The two adjacent surface profiles (4) from two slatwall assemblies (2*a* and 2*b*) can thus be positioned so as to define the gap therebetween, with the gap serving as opening to allow access to the recessed cavity (10) for insertion of the mounting brackets. It should be noted that the configuration of the reinforcing profile (4) can vary to provide a width of the gap between two surface profiles (6) and a shape of the cavity (10) tailored to the mounting brackets to be secured onto the slatwall.

The reinforcing profile (6) is involved in defining the cavity (10) by offering locking or abutment surfaces that can be used to reversibly lock mounting brackets (52) within the cavity (10). The material of the reinforcing profile (6) further contributes to improve the resistance of the slatwall assembly (2) in response to constraints imposed by the items being held via the mounting brackets. The cavity (10) is generally elongated and can extend along a whole length of the profiles (4, 6). Such cavity can be referred to as a mounting channel or groove. The cavity (10) has a front opening (38) to allow insertion and locking of mounting brackets for hanging items. In the configuration illustrated in FIG. 9, the front opening (38) corresponds to the gap between two front vertical panels (20) of adjacent assemblies (2*a*, 2*b*). However, the size of the opening of the cavity could differ from the gap between two front vertical panels depending on the amount of overlap between the front vertical panel of one assembly with the reinforcing profile of the other adjacent assembly.

Still referring to FIG. 9, the reinforcing profile (6) further includes a downward locking tab (40) extending downwardly from a bottom surface of the reinforcing base wall (22). The cavity (10) as illustrated in FIG. 9, for example, is thus defined by the combination of several parts of the profiles (4, 6) which are the base wall (12), the front lip (16), the reinforcing base wall (22) and the downward locking tab (40). The downward locking tab (40) offers a rear abutment surface to a mounting bracket that can be inserted in the cavity (10) and locked against the downward locking tab (40). Depending on the design of the mounting bracket, the top surface of the base wall (12), the front surface of the front lip (16), the bottom surface of the reinforcing base wall (22), the rear surface of the downward locking tab (40) or any combinations thereof can serve to provide abutment and/or locking to a mounting bracket once inserted in the cavity (10).

The mounting brackets as encompassed herein include various hanging means that are available in the art, such as hooks, shelf brackets, bin brackets and other holders for various items which can be locked in place within the cavity of the slatwall assembly. FIGS. 1 and 9 provide an example illustration of mounting brackets (52) serving as a hook. The mounting bracket is inserted between two adjacent surface profiles (4) and engaged with the cavity (10) so as to abut the reinforcing profile (6).

Referring to FIG. 1, a plurality of slatwall assemblies (2) can be assembled to cover the entire surface of an existing wall (not shown), via overlapping of the vertical front wall (20) of a first slatwall assembly (2*a*) over a portion of the reinforcing profile (6) of a second slatwall assembly (2*b*) that is positioned generally below the first slatwall assembly (2*a*). The plurality of slatwall assemblies (2) is secured onto the wall with each surface profile (4) held together with a corresponding reinforcing profile (6), and one slatwall assembly (2*a*) being joined to another slatwall assembly (2*b*) in a way to align and maintain the front vertical panels (20) of the surface profiles (4) at a same distance from the existing wall.

The surface profile and reinforcing profile can be configured in various ways to adjoin a first slatwall assembly to another adjacent slatwall assembly. In the context of the present application, the term "adjacent" should not be interpreted as strictly separate and can allow some overlapping of the parts of one slatwall assembly with the adjacent slatwall assembly when they are adjoined to form a complete slatwall. The partial overlap between two adjacent slatwall assemblies allows to hide one reinforcing profile and corresponding locking surfaces, such that only the front vertical panels and gap therebetween can be seen from a front point of view. Thus, for example referring to FIG. 9, the fastener (8) used to secure the first slatwall assembly (2*a*) can be hidden behind the front vertical panel (20) of the second and upper slatwall assembly (2*b*). In addition, the front vertical panel (20) of the second slatwall assembly (2*b*) is positioned with respect to the first slatwall assembly (2*a*) so as to hide at least both reinforcing base wall (22) and downward tab (40) of the reinforcing profile (6) of the first slatwall assembly (2*a*).

In the implementation illustrated in FIGS. 1 to 9, the front vertical panel of the surface profile of a first slatwall assembly can be adapted to lodge at least a portion of the reinforcing profile of a second slatwall assembly that can be positioned below the first slatwall assembly. More specifically, and referring for example to FIG. 9, the front vertical panel (20) of the surface profile (4) can further include an inward lip (42) extending from a rear surface of the front vertical panel (20) to abut the reinforcing base wall (22) of the reinforcing profile (6) of the first slatwall assembly (2*a*) when the second slatwall assembly (2*b*) partially overlaps the first slatwall assembly (2*a*).

Still referring to FIG. 9, the reinforcing profile (6) can further include an upward locking tab (44) extending upwardly from a top surface of the reinforcing base wall (22). The upward locking tab (44) of the first slatwall assembly (2*a*) can be adapted to abut or operatively cooperate with the inward lip (42) of the front vertical panel (20) of the second and upper slatwall assembly (2*b*) positionable above the first slatwall assembly (2*a*).

Figure 10:
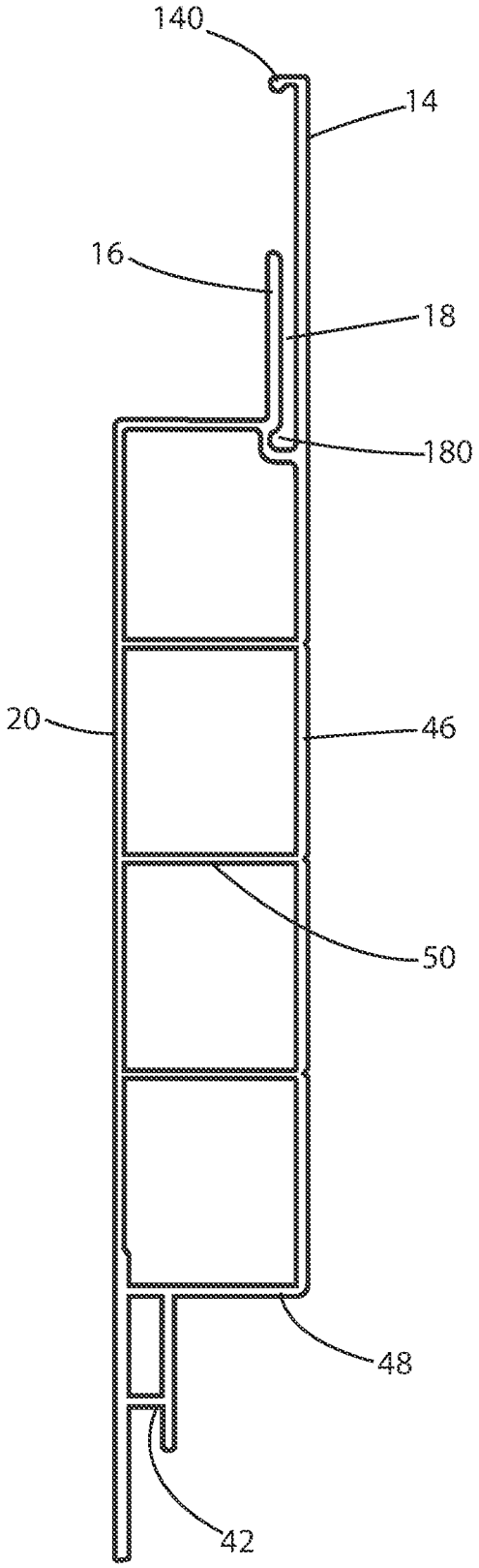
FIG. 10 is a cross-sectional view of another implementation of a surface profile of the slatwall assembly.

FIGS. 10 and 11 show variations in the design of the surface profile in comparison to the surface profile illustrated in FIGS. 1 to 3 and 6 to 9. Various surface treatments can be applied to the front vertical panel (20) of the surface profile to provide any desired aesthetics. For example, an outer surface of the front vertical panel (20) can be laminated with a top layer (not shown) having a specific texture, color and/or graphic pattern. The design of the surface profile (4) can be thus adapted to such surface treatments. For example, as seen on FIGS. 10 and 11, the front vertical panel (20) can be reinforced to reduce bending risks upon receiving the surface treatment. The surface profile (4) can include a rear vertical panel (46) extending downwardly from the base wall (12) and being spaced apart from the front vertical panel (20) so as define a gap therebetween. The gap between the front and rear vertical panels (20, 46) can be closed at one end via a closing wall (48) extending generally horizontally and in parallel relationship with the base wall (12). Optionally, to further reinforce the surface profile (4), one or more additional wall(s) (50) can be distributed within the gap between the front and rear vertical panels (20, 46).

It should be noted that all implementations described and claimed in relation to a "first", "second" or "third" slatwall assembly can be applied in combination to any implementations of a slatwall assembly as defined herein, as the slatwall is formed by the adjoining of identical slatwall assemblies. The slatwall can further include end pieces that are complementary to the surface profile and are used for aesthetic purposes.

While implementations of the hybrid slatwall assembly have been described in detail in relations to an existing vertical wall, it should be understood that the techniques described herein could be applied to cover and functionalize any plane surface including mobile displays.

There is also provided a slatwall kit that includes at least one reinforcing profile and at least one surface profile as described herein in an unassembled state. The reinforcing and surface profiles of the slatwall kit can be further assembled to form the slatwall assembly as described herein. The kit can further include at least one fastener to secure the slatwall assembly onto an existing wall. The kit can further include as many surface profiles and reinforcing profiles that are needed to cover a given surface of an existing wall.

The method to assemble the slatwall assembly from a slatwall kit includes insertion of the reinforcing profile (6) into the dedicated groove (18) of the surface profile (6). Mounting of the slatwall assembly onto the existing wall can further be performed via fastening at least one of the rear vertical wall (24) of the reinforcing profile (6) and rear lip (14) of the surface profile (4) onto the wall, with the downward tab (26) of the reinforcing profile being sandwiched by the surface profile (4). Assembly of a complete slatwall includes providing first and second slatwall assemblies, fastening the first slatwall assembly onto the wall, abutting the second slatwall assembly onto the first slatwall assembly and fastening the second slatwall assembly onto the wall. Abutting the second slatwall assembly onto the first slatwall assembly can include engaging the upward locking tab (44) of the first slatwall assembly against inward lip (42) of the front vertical panel (20) of the second slatwall assembly which is positioned above the first slatwall assembly.

In the present description, an embodiment or implementation is an example feature of the described packing assembly or related techniques. Appearances of "one embodiment," "an embodiment", "some embodiments", or "some implementations" do not necessarily all refer to the same embodiments. Although various features can be described in the context of a single embodiment, the features can also be provided separately or in any suitable combination. Conversely, although the hybrid slatwall assembly can be described herein in the context of separate embodiments for clarity, various features of the assembly can also be implemented in a single embodiment.

It should be noted that the same numerical references refer to similar elements of the assembly. Furthermore, for the sake of simplicity and clarity, namely so as to not unduly burden the figures with several references numbers, not all figures contain references to all the components and features, and references to some components and features can be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only. Therefore, the descriptions, examples, methods and materials presented in the specification are not to be construed as limiting but rather as illustrative only.

What is claimed is:

1. A slatwall assembly for covering at least a portion of an existing building framework, the slatwall assembly comprising:

a surface profile defining a groove and comprising a front vertical panel that is positionable with respect to the existing building framework to define a gap therebetween and provide coverage thereto; and a reinforcing profile being operatively couplable to the surface profile via insertion of the reinforcing profile into the groove of the surface profile and being configured to be held together with the surface profile when the slatwall assembly is mounted onto the existing building framework, the reinforcing profile including a rear profile surface configured to abut the surface profile when operatively coupled thereto, and a frontmost profile surface opposite the rear profile surface, and the reinforcing profile being made of a different material than that of the surface profile, the material of the reinforcing profile having an enhanced ability to withstand an applied load without plastic deformation or failure, in comparison to the surface profile alone;

wherein the slatwall assembly, when the reinforcing profile is operatively coupled to the surface profile, defines a cavity that is recessed with respect to the front vertical panel of the surface profile and having a front opening to allow insertion and locking of at least one mounting bracket for hanging items onto the existing building framework;

wherein the slatwall assembly is a first slatwall assembly and the front vertical panel of the surface profile of the first slatwall assembly is adapted to at least partially lodge the reinforcing profile of a second slatwall assembly that is positionable below the first slatwall assembly, the front vertical panel of the surface profile being shaped and dimensioned to conceal at least a portion of the frontmost profile surface of the reinforcing profile of the second slatwall assembly behind the front vertical panel of the first slatwall assembly.

2. The slatwall assembly of claim 1, wherein:

the surface profile further comprises:

a base wall that is horizontally extending, with the front vertical panel extending downwardly from the base wall so as to be spaced apart from the existing building framework and define the gap therebetween, a rear lip extending upwardly from the base wall, the rear lip having a rear surface being positionable directly onto the existing building framework, and a front lip extending upwardly from the base wall and being spaced apart from the rear lip to define the groove therebetween; and the reinforcing profile comprises:

a reinforcing base wall that is horizontally extending, and a rear vertical wall extending laterally from each side of a rear edge of the reinforcing base wall, thereby defining an upward tab and a downward tab;

wherein the reinforcing profile is operatively coupled to the surface profile via insertion of the downward tab of the reinforcing profile into the groove of the surface profile.

3. The slatwall assembly of claim 2, wherein a rear surface of the rear vertical wall of the reinforcing profile defines the rear profile surface of the reinforcing profile and abuts a front surface of the rear lip of the surface profile.

4. The slatwall assembly of claim 2, wherein the rear lip includes a top overhang extending from a top edge of the rear lip, and the top overhang abuts a top edge of the rear vertical wall when the reinforcing profile is operatively coupled to the surface profile.

5. The slatwall assembly of claim 2, wherein the groove of the surface profile is shaped to include a recess, and the downward tab of the rear vertical wall comprises an overhang that is nested in the recess of the groove when the reinforcing profile is operatively coupled to the surface profile.

6. The slatwall assembly of claim 5, wherein the recess is located in a bottom portion of the groove and the overhang of the downward tab extends from a bottom edge of the rear vertical wall.

7. The slatwall assembly of claim 2, wherein the front lip is sized differently from the rear lip of the surface profile.

8. The slatwall assembly of claim 2, wherein the front lip is sized to cover at least a portion of the reinforcing profile.

9. The slatwall assembly of claim 2, wherein at least one of the reinforcing profile and the surface profile is securable onto the existing building framework via at least one fastener.

10. The slatwall assembly of claim 9, wherein both the reinforcing profile and the surface profile are securable onto the existing building framework by being held together via the at least one fastener.

11. The slatwall assembly of claim 9, wherein the upward tab of the rear vertical wall of the reinforcing profile is adapted to cooperate with the fastener to hold the reinforcing profile and the surface profile together onto the existing building framework via the fastener.

12. The slatwall assembly of claim 2, wherein the reinforcing profile further includes a downward locking tab extending downwardly from a bottom surface of the reinforcing base wall, with the downward locking tab, the reinforcing base wall, the front lip of the surface profile and the base wall of the surface profile forming the cavity.

13. The slatwall assembly of claim 1, wherein the reinforcing profile is made of metal, carbon fibers or fiberglass.

14. The slatwall assembly of claim 1, further comprising a top layer that is laminated on a front surface of the front vertical panel to provide a given color, pattern and/or texture thereto.

15. The slatwall assembly of claim 1, wherein the surface profile is made of at least one of plastic, polymer composite material, wood, wood composite material and cardboard.

16. The slatwall assembly of claim 1, wherein the reinforcing profile made of metal, carbon fibers or fiberglass, and the surface profile is made of at least one of plastic, polymer composite material, wood, wood composite material and cardboard.

17. The slatwall assembly of claim 1, wherein the front vertical panel of the surface profile is shaped and dimensioned to conceal an entirety of the frontmost profile surface of the reinforcing profile of the second slatwall assembly behind the front vertical panel of the first slatwall assembly.

18. The slatwall assembly of claim 2, wherein the front vertical panel of the surface profile is shaped and dimensioned to conceal both the reinforcing base wall and upward tab of the reinforcing profile of the second slatwall assembly behind the front vertical panel of the first slatwall assembly.

19. The slatwall assembly of claim 1, wherein the reinforcement profile defines an abutment surface shaped to enable a reversible locking of the at least one mounting bracket within the cavity.

20. The slatwall assembly of claim 1, wherein the cavity extends an entire width of the slatwall assembly.

* * * * *